US007226515B2

(12) United States Patent
Itoh et al.

(10) Patent No.: US 7,226,515 B2
(45) Date of Patent: Jun. 5, 2007

(54) FE—NI BASED PERMALLOY AND METHOD OF PRODUCING THE SAME AND CAST SLAB

(75) Inventors: Tatsuya Itoh, Kanagawa (JP); Tsutomu Omori, Kanagawa (JP)

(73) Assignee: Hippon Yakin Kogyo Co., Ltd., Tokyo (JP)

( * ) Notice: Subject to any disclaimer, the term of this patent is extended or adjusted under 35 U.S.C. 154(b) by 340 days.

(21) Appl. No.: 10/424,818

(22) Filed: Apr. 29, 2003

(65) Prior Publication Data

US 2003/0205296 A1 Nov. 6, 2003

Related U.S. Application Data

(62) Division of application No. 09/961,366, filed on Sep. 25, 2001, now Pat. No. 6,656,419.

(30) Foreign Application Priority Data

Sep. 29, 2000 (JP) ..... 2000-300632
Jan. 31, 2001 (JP) ..... 2001-023275

(51) Int. Cl.
*C22C 38/08* (2006.01)
*C22C 19/03* (2006.01)
*C22C 30/00* (2006.01)

(52) U.S. Cl. ..... 148/310; 148/312; 420/94; 420/459; 420/581

(58) Field of Classification Search ..... None
See application file for complete search history.

(56) References Cited

U.S. PATENT DOCUMENTS

| | | | | |
|---|---|---|---|---|
| 5,135,588 | A | 8/1992 | Okiyama et al. | |
| 5,325,911 | A * | 7/1994 | Tsuda et al. | 164/477 |
| 5,396,146 | A | 3/1995 | Nakamura et al. | |
| 5,500,057 | A | 3/1996 | Inoue et al. | |
| 5,525,164 | A | 6/1996 | Inoue et al. | |
| 5,669,989 | A | 9/1997 | Inoue et al. | |
| 5,783,145 | A | 7/1998 | Coutu et al. | |
| 6,099,669 | A | 8/2000 | Yuki et al. | |
| 6,632,298 | B1 * | 10/2003 | Morita et al. | 148/336 |

FOREIGN PATENT DOCUMENTS

| | | |
|---|---|---|
| DE | 19904951 | 8/2000 |
| EP | 0407608 | 6/1994 |
| EP | 0792943 | 9/1997 |
| JP | 60-2651 | 1/1985 |
| JP | 61-003835 | 1/1986 |
| JP | 61-147846 | 7/1986 |
| JP | 61-147847 | 7/1986 |
| JP | 62142749 | 6/1987 |
| JP | 1-252725 | 10/1989 |
| JP | 2-030743 | 2/1990 |
| JP | 2-170922 | 7/1990 |
| JP | 2-225621 | 9/1990 |
| JP | 3-207838 | 9/1991 |
| JP | 4-202642 | 7/1992 |
| JP | 7-78270 | 8/1995 |
| JP | 8-013101 | 1/1996 |
| JP | 8-193248 | 7/1996 |
| JP | 8-199270 | 8/1996 |
| JP | 2620353 | 3/1997 |
| JP | 2803552 | 7/1998 |
| JP | 2000-001721 | 1/2000 |
| JP | 200073108 | 3/2000 |
| TW | 367371 | 11/1997 |
| WO | 88/02677 | 4/1988 |
| WO | 90/08201 | 7/1990 |
| WO | 00/72995 | 12/2000 |

OTHER PUBLICATIONS

English Language Abstract of JP 60-2651.
English Language Abstract of JP 62-142749.
English Language Abstract of JP 2620353.
English Language Abstract of JP 2000-73108.
English Language Abstract of EP 0792943.
English Language Abstract of DE 19904951.
English Language Abstract of TW 367371.
English Language Abstract of JP 2-170922.
English Language Abstract of JP 4-202642.
English Language Abstract of JP 8-193248.
English Language Abstract of W.I.P.O. 90/08201.
English language Abstract of JP 8-013101, Published Jan. 16, 1996.
English language Abstract of JP 08-199270, Published Aug. 6, 1996.
English language Abstract of JP 61-003835, Published Jan. 9, 1986.
English language Abstract of JP 01-252725, Published Oct. 9, 1989.
English language Abstract of JP 2-225621, Published Sep. 7, 1990.
English language Abstract of JP 61-147846, Published Jul. 5, 1986.
English language Abstract of JP 61-147847, Published Jul. 5, 1986.
English language Abstract of JP 2000-001721, Published Jan. 7, 2000.
English language Abstract of JP 2803522, Published Jul. 17, 1998.
"The 5th revised edition of Heat Treatment of Steel," published by Nobuo Suzuki, Japan Iron and Steel Institute of Japan, Oct. 5, 1995, pp. 621-623, together with a partial English language translation of the same.
English Language Abstract of JP 2-030743.
English Language Abstract of JP 3-207838.
English Language Abstract of JP 7-78270, published Aug. 23, 1995.

* cited by examiner

*Primary Examiner*—Harry D. Wilkins, III
(74) *Attorney, Agent, or Firm*—Greenblum & Bernstein, P.L.C.

(57) ABSTRACT

A Fe—Ni based permalloy comprises Ni: 30–85 wt %, C: not more than 0.015 wt %, Si: not more than 1.0 wt %, Mn: not more than 1.0 wt %, P: not more than 0.01 wt %, S: not more than 0.005 wt %, O: not more than 0.0060 wt %, Al: not more than 0.02 wt % and, if necessary, not more than 15 wt % of at least one selected from the group consisting of Mo, Cu, Co and Nb within a range of not more than 20 wt % in total.

2 Claims, 2 Drawing Sheets

(a)

Equiaxed crystal of not more than 1%

(b)

Equiaxed crystal zone

Equiaxed crystal (20%)

FE—NI BASED PERMALLOY AND METHOD OF PRODUCING THE SAME AND CAST SLAB

CROSS-REFERENCE TO RELATED APPLICATIONS

This application is a divisional of application Ser. No. 09/961,366, filed Sep. 25, 2001 now U.S. Pat. No. 6,656,419. The entire disclosure of application Ser. No. 09/961,366 is considered as being part of the disclosure of this application, and the entire disclosure of application Ser. No. 09/961,366 is expressly incorporated by reference herein in its entirety.

This application is related to Japanese Application Nos. 2000-300632, filed Sep. 29, 2000, and 2001-023275, filed Jan. 31, 2001 whose priorities are claimed.

BACKGROUND OF THE INVENTION

1. Field of the Invention

This invention relates to a Fe—Ni based permalloy suitable for use in a magnetic head, a magnetic shielding material, an iron core of a transformer or the like and having excellent magnetic properties and a method of producing the same as well as a cast slab.

2. Description of Related Art

As the Fe—Ni based high magnetic permeability alloy or so-called permalloy, there are usually typified PB material (40–50 wt % Ni), PC material (70–85 wt % Ni—Mo—Cu), PD material (35–40 wt %-Ni—Fe),and the like, which are defined according to JIS C2531. Among these alloys, the PB material is mainly used in applications utilizing the characteristic that saturated magnetic flux density is large, such as stator in a watch, pole piece in an electromagnetic lens and the like, while the PC material is used as a high sensitivity transformer or a magnetic shielding material at a high frequency zone utilizing an excellent permeability. Among these alloys, it is designed to cope with applications such as a magnetic head, a shield case and the like by adding an additional element such as Nb, Cr or the like to provide the abrasion resistance and corrosion resistance (for example, JP-A-60-2651).

As another example of improving the properties of these alloys, JP-A-62-142749 and the like disclose that the permeability and the punching property are improved by adjusting impurity elements such as S, O and the like. Recently, the movement from PC material to PB material or from PB material to PD material is observed for reducing the cost, or there is adopted a method of supplementing for the lack of material properties by designing a fabricator.

In the material makers, therefore, it is strongly noticed to develop materials such as PB material having properties corresponding to those of PC material or PD material having properties corresponding to those of PB material. This increases a degree of freedom in the design of fabricator and hence is effective to give products having higher performances to markets.

SUMMARY OF THE INVENTION

It is, therefore, an object of the invention to provide a Fe—Ni based permalloy satisfying the above demand. That is, the invention is to improve the magnetic properties of PB material and PD material to grade up to the magnetic properties corresponding to those of PC material and PB material and to further improve the magnetic properties of PC material and to develop materials capable of coping with applications of high sensitivity and frequency.

The inventors have made various studies in order to achieve the above object and found that Fe—Ni based permalloys having the following constructions are preferable and as a result the invention has been accomplished.

The invention lies in a Fe—Ni based permalloy comprising Ni: 30–85 wt %, C: not more than 0.015 wt %, Si: not more than 1.0 wt %, Mn: not more than 1.0 wt %, P: not more than 0.01 wt %, S: not more than 0.005 wt %, O: not more than 0.006 wt %, Al: not more than 0.02 wt % and the remainder being Fe and inevitable impurities, provided that Ni segregation amount $C_{Ni}s$ represented by the following equation is not more than 0.15 wt %, preferably 0.10 wt %.

$$C_{Ni}s = \text{analytical value of Ni component (wt \%)} \times Ci_{Ni}s\ (c.p.s.)/Ci_{Ni}\text{ave. } (c.p.s.)$$

wherein $Ci_{Ni}s$ is a standard deviation of X-ray intensity (c.p.s.) and $Ci_{Ni}$ave. is an average intensity of all X-ray intensites (c.p.s.).

In addition to the above constitutional components, the alloy according to the invention is favorable to contain not more than 15 wt % of at least one selected from the group consisting of Mo, Cu, Co and Nb within a range of not more than 20 wt % in total.

And also, the alloy according to the invention is favorable to control an amount of non-metallic inclusion having a diameter corresponding to a circle of not less than 0.1 μm to not more than 20 particles/mm$^2$, preferably not more than 10 particles/mm$^2$.

Furthermore, the alloy according to the invention is favorable to have the following constructions:

(1) The alloy containing 35–40 wt % of Ni exhibits such magnetic properties that a maximum magnetic permeability μm is not less than 50000, an initial magnetic permeability μi is not less than 10000 and a coercive force Hc is not more than 0.05 (Oe);

(2) The alloy containing 40–50 wt % exhibits such magnetic properties that a maximum magnetic permeability μm is not less than 100000, an initial magnetic permeability μi is not less than 30000 and a coercive fore Hc is not more than 0.02 (Oe);

(3) The alloy containing 70–85 wt % exhibits such magnetic properties that a maximum magnetic permeability μm is not less than 400000, an initial magnetic permeability μi is not less than 20000 and a coercive force Hc is not more than 0.006 (Oe).

And also, the invention proposes a method of producing a Fe—Ni based permalloy, which comprises continuously casting an alloy comprising Ni: 30–85 wt %, C: not more than 0.015 wt %, Si: not more than 1.0 wt %, Mn: not more than 1.0 wt %, P: not more than 0.01 wt %, S: not more than 0.005 wt %, O: not more than 0.0060 wt %, Al: not more than 0.02 wt %, and, if necessary, not more than 15 wt % of at least one selected from the group consisting of Mo, Cu, Co and Nb within a range of not more than 20 wt % in total and the reminder being Fe and inevitable impurities into a slab, and subjecting the continuously cast slab to a homogenizing heat treatment and further to a hot rolling.

In the production method according to the invention, it is favorable that the continuous casting is carried out without applying an electromagnetic agitation, and that a cast slab for the permalloy having an area ratio of equiaxed crystal in a cast texture of a continuously cast slab of not more than 1% is used.

As the homogenizing heat treatment, it is favorable that the continuously cast slab is treated at a temperature of 1100–1375° C. under a condition that Ni diffusion distance $D_{Ni}$ represented by the following equation is not less than 39:

$$D\text{Ni}=(D\ t)^{1/2}/\mu\text{m}$$

wherein D: diffusion coefficient, $D=D_0\times\exp(-Q/RT)$, $D_0$: vibration number item=$1.63\times10^8/\mu m^2\ s^{-1}$ Q: activation energy of Ni diffusion=$2.79\times10^5$/J $mol^1$ R: gas constant=8.31/J $mol^1\ K^{-1}$ T: temperature/K t: annealing time/s Furthermore, a cold rolling is carried out to produce a product after the hot rolling step, if necessary. And also, it is favorable to conduct a magnetic heat treatment of 1100–1200° C. after the cold rolling step. Such a magnetic heat treatment is favorable to be carried out in a hydrogen atmosphere.

Moreover, the cold rolling step may include usually used steps such as annealing, BA, pickling and the like. And also, the cast slab used herein may include a cast ingot for the formation of usual ingot in addition to the continuously cast slab.

BRIEF DESCRIPTION OF THE DRAWINGS

The invention will be described with reference to the accompanying drawings: wherein.

DETAILED DESCRIPTION OF THE INVENTION

Figure 1:
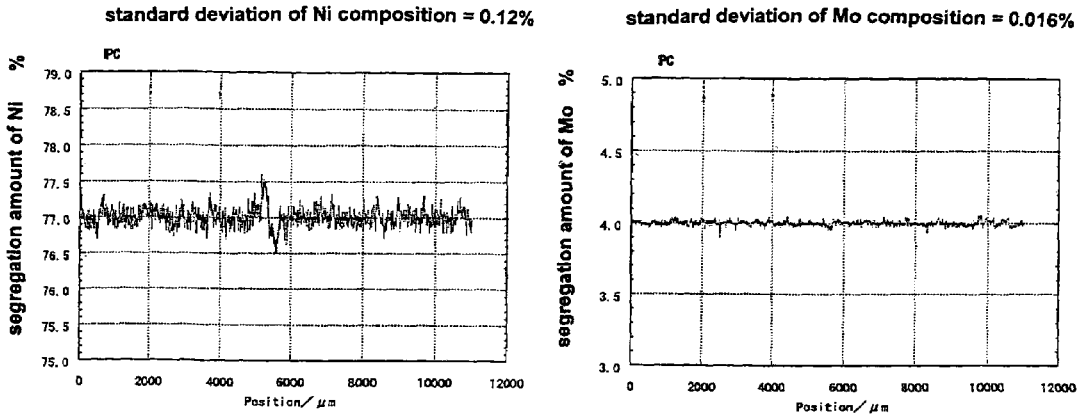
FIG. 1 is a schematic view illustrating a method of measuring Ni segregation amount of Ni.

As a result that the inventors have made many experiments, it has been found that it is effective to adopt the following means for solving the above matters, and the invention has been developed.

That is, the invention is characterized in that an alloy comprising Ni: 30–85 wt %, C: not more than 0.015 wt %, Si: not more than 1.0 wt %, Mn: not more than 1.0 wt %, P: not more than 0.01 wt %, S: not more than 0.005 wt %, O: not more than 0.0060 wt %, Al: not more than 0.02 wt %, and, if necessary, 1–15 wt % of at least one selected from the group consisting of Mo, Cu, Co and Nb within a range of not more than 20 wt % in total and the reminder being Fe and inevitable impurities is shaped into a slab through a continuous casting, and then the continuously cast slab is subjected to a homogenizing heat treatment and further to a hot rolling after a surface treatment to render Ni segregation amount $C_{Ni}$s into not more than 0.15 wt %, preferably not more than 0.12 wt %, more particularly not more than 0.10 wt %.

The reason why the Ni segregation amount is particularly noticed in the invention is due to the fact that Ni is a most important component among the constitutional components and is slow in the diffusion rate in the alloy and serves as a rate-determining of the homogenizing.

In the invention, therefore, the continuously cast slab is subjected to a homogenizing heat treatment at a higher temperature for a long time as mentioned later as a method of providing a desired Ni segregation amount.

Moreover, when the slab is hot rolled without being subjected to the homogenizing heat treatment, the Ni segregation amount of the hot rolled material is usually about 0.4%.

According to the inventors' studies, it has been found that when the homogenizing heat treatment is carried out so as to satisfy the following temperature and time conditions, there can be obtained materials having the segregation amount lower than the initially anticipated value. That is, according to the inventors' various experiments, it has been found that the Ni segregation amount of the hot rolled material after the hot rolling can be decreased to 0.15 wt % by conducting the homogenizing heat treatment under conditions that the value $(D\cdot t)^{1/2}$ of the Ni diffusion distance $D_{Ni}$ represented by the following equation (1) is not less than 39 and the heat treating temperature T is within a range of 1100–1375° C.:

$$\text{Ni diffusion distance } D_{Ni}=(D\cdot t)^{1/2}/\mu\text{m} \quad (1)$$

wherein D: diffusion coefficient, $D=D_0\times\exp(-Q/RT)$, $D_0$: vibration number item=$1.63\times10^8/\mu m^2\ s^{-1}$ Q: activation energy of Ni diffusion=$2.79\times10^5$/J $mol^1$ R: gas constant=8.31/J $mol^1\ K^{-1}$ T: temperature/K t: annealing time/s.

In the above equation (1), the value $(D\cdot t)^{1/2}$ is an indication showing a degree of decreasing Ni segregation. As the temperature becomes higher and the time becomes longer, the value becomes larger and the segregation becomes decreased.

Moreover, as an indication showing the degree of Ni segregation, a standard deviation is determined from the data of Ni concentration distribution obtained by linear analysis of EPMA (X-ray microanalyzer), which is used as Ni segregation amount.

In the above homogenizing heat treatment, when the temperature is lower than 1100° C., the treating time becomes undesirably too long, while when it exceeds 1375° C., the yield is lowered due to the oxidation loss and there is caused a risk of brittle crack through heating. In the invention, therefore, the heat treating temperature is within a range of 1100–1375° C.

And also, non-metal inclusions included in the alloy are noticed in the invention, and the size and number thereof are defined. That is, the ratio of the non-metal inclusion having a diameter of not less than 0.1 μm is controlled to not more than 20 particles/$mm^2$, preferably not more than 15 particles/$mm^2$, more particularly not more than 10 particles/$mm^2$.

As a method of controlling the distribution of the non-metal inclusions, it is advantageous to use a high cleaning technique such as smelting through dissolution under vacuum, deoxidizing with C or the like.

Moreover, the Ni segregation amount $C_{Ni}$s (wt %) at section of plate is calculated according to the following equation (2) based on FIG. 1 after the section of the plate is subjected to mirror polishing in usual manner and analyzed through EPMA (X-ray microanalyzer) under conditions shown in Table 1. In this case, the scanning distance is substantially a full length of the plate in thickness direction:

$$C_{Ni}\text{s (wt \%)}=\text{analytical value of Ni component (wt \%)}\times C_{Ni}\text{S } (c.p.s.)/\text{Ci}_{Ni}ave.\ (c.p.s.) \quad (2)$$

wherein $\text{Ci}_{Ni}$s: standard deviation of X-ray intensity at section of plate (c.p.s.) represented by $$Ci_{Ni}S = \sqrt{\frac{1}{n}\sum^{n}(Ci_{Ni} - Ci_{Ni}ave.)^2}$$

$Ci_{Ni}$ave.: average intensity of total X-ray intensities at section of plate (c.p.s.).

The above analytical value of Ni component (wt %) is a Ni content included in the starting material and an analytical value by a chemical or physical method.

Figure 2:
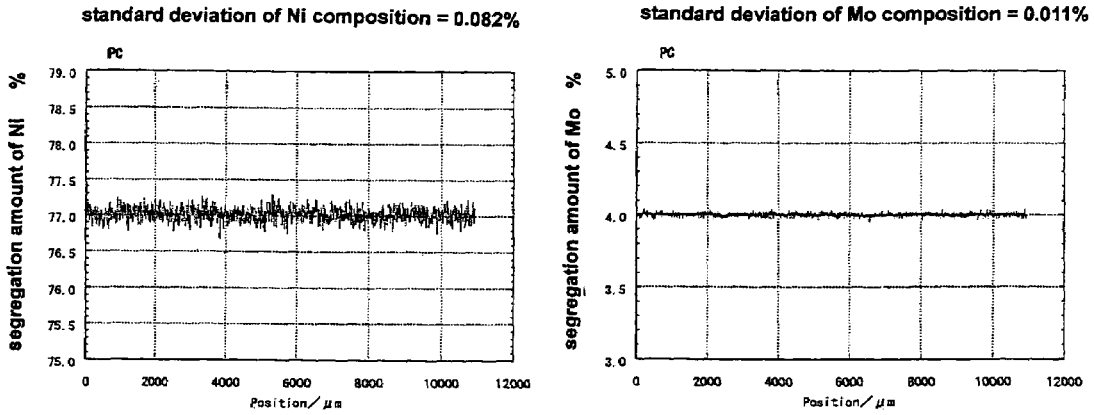
FIG. 2 is a graph showing found data of results measured on Ni segregation amount in PB material.

FIG. 2 is a graph of found data showing results measured on Ni segregation amount of PB material in a hot rolled plate having a thickness of 5 mm. The same measurement is carried out with respect to cold rolled sheet or magnetic heat-treated sheet having a thickness of about 0.2 mm.

TABLE 1

| | |
|---|---|
| Probe diameter | 1 μm |
| Irradiated current | 5.0 × 10-7 A |
| Acceleration voltage | 20 kV |
| Measuring time | 0.5 sec/point |
| Measuring interval | 2 μm |
| Spectrocrystal | LIF |

And also, the measurement of the number of non-metal inclusions is carried out by the following method. Firstly, a surface of a product is subjected to a mechanical polishing and finished by buffing and thereafter the polished surface is subjected to an electrolysis at a constant potential field (Speed process) in a nonaqueous solvent (10 v/v % acetylacetone+1 w/v % tetramethyl ammonium chloride+methanol solution). The electrolysis is carried out in a potential field of 10 C (Coulomb)/$cm^2$ at 100 mV. As the observation is conducted by a scanning type electron microscope (SEM), non-metal inclusions having a diameter corresponding to circle of not less than 0.1 μm are counted at 1 $mm^2$. Moreover, the term "diameter corresponding to circle" means a diameter when individual inclusion is converted into a true circle.

As seen from the above, the invention lies in a point that the characteristics of the alloy are considerably improved without largely changing the component composition. This can be considered as follows. That is, there are various factors dominating the soft magnetic properties of the alloy. For example, there are well-known size of crystal grain, crystal orientation, impurity component, non-metal inclusion, vacancy and the like. In the silicon steel sheets, however, it is known that the soft magnetic properties in a particular direction are considerably improved to highly improve power efficiency of al alternating current transformer by controlling the crystal orientation.

On the contrary, according to the invention, it has been found that the magnetic properties of the Fe—Ni based permalloy can largely be improved by noticing the segregation of Ni, which has never been considered up to the present time, and controlling it. And also, adequate production conditions are found out therefor.

In the invention, the alloy characteristics are controlled by controlling the segregation of Ni, which is particularly slow in the diffusion rate among segregations of the components. However, as a result of various examinations, it has been found that it is effective to simultaneously control the non-metal inclusions and crystal grain size for improving the characteristics to desirable levels.

The control of such non-metal inclusions is carried out by rationalizing vacuum dissolution and deoxidation method and reducing elements producing elements producing oxide and sulfide. On the other hand, the control of the crystal grain (coarsening) can be realized by mitigating the component segregation and decreasing the amount of the non-metal inclusion such as sulfide, oxide and the like, for example, MnS, CaS and so on. In this case, the control of the non-metal inclusion is effective in view of two points such as the improvement of magnetic properties by reducing the inclusion itself and the improvement of magnetic properties by controlling the crystal grain.

Moreover, the degree of influence differs in accordance with the components of the alloy in these control factors. For example, the influence of grain size, segregation is large in the PD material and PB material, while the influence of non-metal inclusion and component segregation is large in the PC material.

As a method of reducing Ni segregation, which is inevitable for realizing the function and effect of the invention, it is effective to conduct a diffusion heat treatment at a high temperature for a long time as previously mentioned. According to the inventors' studies, it has been found that the segregation of Ni is closely related to a dendrite arm interval of solidification texture and it is advantageous to mitigate Ni segregation as the dendrite arm interval is small. In this case, it has been confirmed that when the continuously cast material is compared with the usual ingot material, the dendrite arm interval is as very small as ⅕–1/10 and in case of using the continuously cast material, Ni segregation can be mitigated at a small energy.

In case of the alloys according to the invention satisfying the above crystal grain size and the amount and shape of the non-metal inclusion, when the magnification of Ni segregation amount is restricted to not more than 0.15 wt %, the permeability can be made to 2–5 times that of the conventional alloy and the coercive force can be made to about ½–⅐ thereof, and hence the improving effect becomes higher as the Ni segregation amount becomes small.

As a result, the invention can provide PB material as a substitute of PC material, PD material as a substitute of PB material, or PC material having higher magnetic properties.

That is, it is a preferable embodiment that the following characteristics are required in the PB material (40–59 wt % Ni) as a substitute of PC material:

1. Higher permeability: at least maximum permeability μm not less than 100000, initial permeability μi=not less than 30000;
2. Small coercive force: at least coercive force Hc=not more than 0.02 (Oe);
3. Excellent high frequency characteristic: effective permeability μe at, for example, a thickness of 0.35 mm, 1 Khz=not less than 4000. Moreover, as to the high frequency characteristic, even when there is no difference in the effective permeability μm at the same thickness, the magnetic flux density in PB material is larger (about 2 times) than that of PC material, so that the thickness can be more thinned, which is advantageous in view of design of magnetic circuit, weight reduction and reduction of cost.

And also, it is a preferable embodiment that the following characteristics are required in the PD material (35–40 wt % Ni) as a substitute of PB material:

1. High permeability: at least maximum permeability μm=not less than 50000, initial permeability μi=not less than 10000;

2. Small coercive force: at least coercive force Hc=not more than 0.05 (Oe);
3. Excellent high frequency characteristic: effective permeability μe at, for example, thickness of 0.35 mm, 1 kHz=not less than 3000 (Since an electric resistance value of the PD material is high, the difference of high frequency characteristic between PB material and PD material is originally small).

Furthermore, in order to improve the characteristics of the PC material (70–85 wt % Ni), it is intended to more improve the permeability and reduce the coercive force. As a numerical target value, there are maximum permeability μm=not less than 400000, initial permeability μi=not less than 200000, and coercive force Hc=not more than about 0.006 (Oe).

The reason why the composition of the alloy components according to the invention is limited to the above range will be described below.

(1) C: not more than 0.015 wt %; C is an element degrading soft magnetic properties because when the amount exceeds 0.015 wt %, carbide is formed to control the crystal growth. Therefore, the C amount is limited to not more than 0.015 wt %.

(2) Si: not more than 1.0 wt %; Si is added as a deoxidizing component, but when the amount exceeds 1.0 wt %, a silicate based oxide is formed as a start point of forming sulfide such as MnS or the like. The resulting MnS is harmful for the soft magnetic properties and forms a barrier for the movement of domain wall, so that the Si amount is desirable to be as small as possible. Therefore, the Si amount is limited to not more than 1.0 wt %.

(3) Mn: not more than 1.0 wt %; Mn is added as a deoxiidizing component, but when the amount exceeds 1.0 wt %, the formation of MnS is promoted to degrade the soft magnetic properties likewise Si. In the PC material or the like, however, Mn acts to control the formation of ordered lattice against the magnetic properties, so that it is desired to add it at an adequate content. Therefore, the Mn amount is limited to not more than 1.0 wt %, preferably a range of 0.01–1.0 wt %.

(4) P: not more than 0.01 wt %; When the P amount is too large, it is precipitated in the grains as a phosphoride to degrade the soft magnetic properties, so that the P amount is limited to not more than 0.01 wt %.

(5) S: not more than 0.005 wt %; When the S amount exceeds 0.005 wt %, it easily forms a sulfide inclusion and diffuses as MnS or CaS. Particularly, these sulfides have a diameter of about 0.1 μm to about few μm, which is substantially the same as the thickness of the domain wall in case of the permalloy and is harmful against the movement of the domain wall to degrade the soft magnetic properties, so that the S amount is limited to not more than 0.005 wt %.

(6) Al: not more than 0.02 wt %; Al is an important deoxidizing component. When the amount is too small, the deoxidation is insufficient and the amount of non-metal inclusion increases and the form of sulfide is easily changed into MnS by the influence of Mn, Si to control the grain growth. On the other hand, when it exceeds 0.02 wt %, constant of magnetostriction and constant of magnetic anisotropy becomes high to degrade the soft magnetic properties. Therefore, an adequate range of Al added is not more than 0.02 wt %, preferably 0.001–0.02 wt %.

(7) O: not more than 0.0060 wt %; O is decreased by deoxidation to finally remain in steel, but it is divided into O remaining in steel as a solid solution and O remaining as an oxide of non-metal inclusion or the like. It is known that as the O amount becomes large, the amount of the non-metal inclusion necessarily increases to badly affect the magnetic properties, and at the same time it affects the existing state of S. That is, when the amount of remaining O is large, the deoxidation is insufficient, and the sulfide is easily existent as MnS to obstruct the movement of domain wall and the grain growth. From these facts, the O amount is limited to not more than 0.0060 wt %.

(8) Mo: not more than 15 wt %; Mo is an effective component for providing the magnetic properties of PC material under practical production conditions and has a function of controlling the forming condition of ordered lattice exerting upon the crystal magnetic anisotropy and magnetostriction. The ordered lattice is influenced by cooling conditions after the magnetic heat treatment. If Mo is not included, a very fast cooling, rate is required, while if Mo is included in a certain amount, maximum properties can be obtained under a practical cooling condition in industry. However, when the amount is too large, an optimum cooling rate becomes too late or the Fe content becomes small and the saturated magnetic flux density becomes low. Therefore, the Mo amount is preferable to be 1–15 wt %.

(9) Cu: not more than 15 wt %; Cu has an action of mainly controlling the forming condition of the ordered lattice in the PC material likewise Mo, but acts to decrease the influence of the cooling rate to stabilize the magnetic properties as compared with the effect of Mo. And also, it is known that the addition of Cu in an adequate amount enhances the electric resistance and improves the magnetic properties under alternating current. However, when the Cu amount is too large, the Fe content becomes small and the saturated magnetic flux density becomes low. Therefore, the Cu amount is not more than 15 wt %, preferably 1–15 wt %.

(10) Co: not more than 15 wt %; Co enhances the magnetic flux density and at the same time acts to improve the permeability by addition of an adequate amount. However, when the Co amount is too large, the permeability lowers and also the Fe content becomes small and the saturated magnetic flux density becomes low. Therefore, the Co amount is not more than 15 wt %, preferably 1–15 wt %.

(11) Nb: not more than 15 wt %; Nb is less in the effect on the magnetic properties, but enhances the hardness of the material and improves the abrasion resistance, so that it is an essential component for use in a magnetic head or the like. And also, it is effective to reduce the magnetic degradation due to molding or the like. However, when the amount is too large, the Fe content becomes small and the saturated magnetic flux density becomes low. Therefore, the Nb amount is not more than 15 wt %, preferably 1–15 wt %.

The production method of Fe—Ni based permalloy according to the invention will be described below.

Firstly, an alloy having the above composition is melted and subjected to a continuous casting process to form a continuously cast slab. In this case, it is desirable to conduct the continuous casting without electromagnetic agitation. Then, the thus obtained continuously cast slab is subjected to a homogenizing heat treatment and further to a hot rolling after the surface treatment of the slab. In the thus obtained hot rolled sheet, the Ni segregation amount $C_{Ni}$s can be made to not more than 0.15 wt %.

The above homogenizing heat treatment is suitable to be carried out under a condition that the value $D_{Ni}(D\cdot t)^{1/2}$ of Ni diffusion distance represented by the equation (1) is not less than 39 at a heat treating temperature T of 1100–1375° C.

It is favorable that the slab subjected to the homogenizing heat treatment is repeatedly subjected to cold rolling and annealing after the hot rolling to obtain a product. The thickness of the product is dependent upon the use application, but it is usually not more than 0.1 mm as a thin sheet for lamination in the application requiring high frequency characteristic such as coiled core or the like, and about 0.2–1.0 mm in magnetic yoke, transformer, shielding machine or the like.

Figure 3:
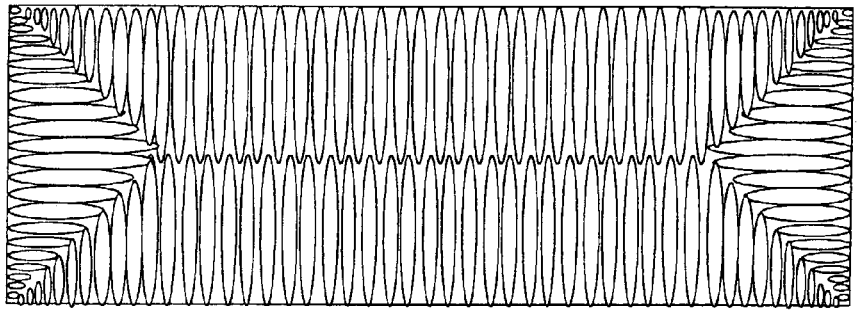
FIGS. 3(*a*) and 3(*b*) are diagrammatically section view of a cast slab.
Figure 3:
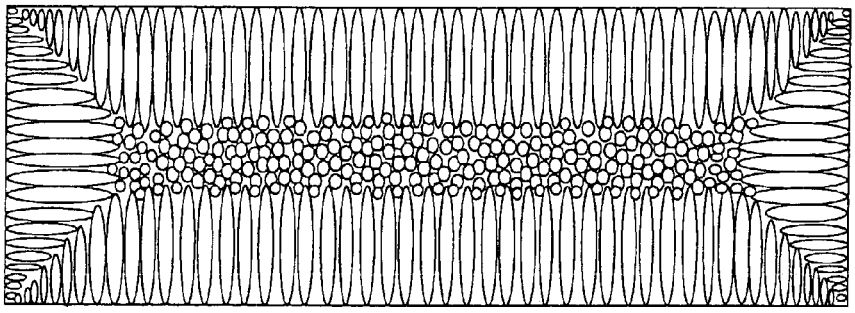

As the slab to be subjected to the hot rolling, it is favorable to use a slab having an equiaxed crystal of not more than 1% as an area ratio of slab section (area of equiaxed crystal/area of slab×100) as shown in FIG. 3*a* because it is more easy to reduce Ni segregation. In case of a slab containing a large equiaxed crystal (20%) as shown in FIG. 3*b*, it is more difficult to reduce Ni segregation. As to the slab used in the invention, the reason why the use of the continuously cast slab without using the electromagnetic agitation is favorable is due to the fact that the continuously cast slab is relatively fast in the solidification rate and less in the equiaxed crystal. And also, when the electromagnetic agitation is not used, the growth of columnar dendrite texture produced in the solidification step is not obstructed and the equiaxed crystal becomes further small. Moreover, FIG. 3 is a diagrammatic view of a section perpendicular to the casting direction of the cast slab. It is possible to use slabs produced by usual ingot forming process if such a slab contains less equiaxed crystal.

The following examples are given in illustration of the invention and are not intended as limitations thereof.

In Table 2 are shown compositions of test materials used in the examples. Among the test materials, 10 tons of a starting material corresponding to PC material is melted under vacuum, while 60 tons of starting materials corresponding to PD and PB materials are melted in air, and then these melts are continuously cast. A part of the continuously cast slabs is subjected to a homogenizing heat treatment, and the remaining slabs are not subjected thereto, which are then hot rolled, and subjected repeatedly to cold rolling and annealing and finally to a temper rolling of few % to obtains products having a thickness of 0.35 mm. Thereafter, the thus obtained test materials are subjected to a magnetic heat treatment in a hydrogen atmosphere at 1100° C. for 3 hours to measure direct current magnetization property and alternating current magnetization property (effective permeability μe). The Ni segregation is measured in the hot rolled sheet, cold rolled sheet and magnetic heat-treated sheet at a section in a thickness direction, respectively. The degree of Ni segregation in the hot rolled sheet is approximately equal to that of the cold rolled sheet after the magnetic heat treatment. The Ni segregation amount is a measured value of the magnetic heat-treated sheet.

The measurement of the direct current magnetization property is carried out by winding wire around a ring-shaped test specimen of JIS $45_{\varphi}\times33_{\varphi}50$ turns on each of primary and secondary sides and measuring through a reversed magnetic field of 20 Oe, while the alternating current magnetization property is evaluated by winding 70 turns and measuring an effective permeability at a current of 0.5 mA and a frequency of 1 kHz. As the initial permeability μi, the intensity of magnetic field is measured at 0.01 Oe in case of PB material and 0.005 Oe in case of PC material according to the definition of JIS C2531.

The test results are shown in Table 3 for PD corresponding material (36Ni alloy: Table 2 ①), Table 4 for PB corresponding material (46Ni alloy: Table 2 ②) and Table 5 for PC corresponding material (JIS alloy: Table 2③), respectively. As seen from these tables, the cast slab having an equiaxed crystal ratio of not more than 1% is used in the alloys according to the invention, so that the Ni segregation amount is small and hence the direct current magnetization property and alternating current magnetization property are largely improved. And also, the similar tendency is observed in the alloys ④, ⑤ of Table 2.

That is, it has been confirmed that the PD material (36Ni) has the permeability and coercive force equal to those of the PB material and also the effective permeability is further improved as compared with that of the PB material because the electric resistance is high. Further, it has been confirmed that the PB material has the permeability and coercive force equal to those of the PC material and the saturated magnetic flux density higher than that of the PC material. Moreover, it has been confirmed that the permeability is further improved and the coercive force is lowered in the PC material.

TABLE 2

| | Ni | Mo | Cu | Nb | Co | Fe |
|---|---|---|---|---|---|---|
| Alloy ① corresponding to PD | 35.5 | — | — | — | — | bal. |
| Alloy ② corresponding to PB | 46.5 | — | — | — | — | bal. |
| Alloy ③ corresponding to PC (JIS) | 77.4 | 4.2 | 4.7 | — | — | bal. |
| Alloy ④ corresponding to PC (hard permalloy) | 79.0 | 4.0 | — | 4.5 | — | 12.5 |
| Alloy ⑤ corresponding to PC (high permeability) | 80.1 | 4.5 | — | 2.0 | 1.5 | 11.9 |

TABLE 3

| Materials corresponding to PD (36Ni alloy) | | | | | | | | | |
|---|---|---|---|---|---|---|---|---|---|
| | Trace components | | | | | | | Homogenizing heat treatment | |
| No. | C | Si | Mn | P | S | Al | O/ppm | Temperature · Time | $(D \cdot t)^{0.5}$/μm |
| Example | | | | | | | | | |
| 1 | 0.005 | 0.05 | 0.2 | 0.001 | 0.0007 | 0.005 | 20 | 1350° C. × 50 hr | 175.5 |
| 2 | 0.004 | 0.06 | 0.3 | 0.002 | 0.0005 | 0.007 | 15 | 1250° C. × 45 hr | 84.5 |
| 3 | 0.005 | 0.04 | 0.3 | 0.002 | 0.0008 | 0.01 | 19 | 1250° C. × 10 hr | 39.8 |
| 4 | 0.006 | 0.02 | 0.2 | 0.002 | 0.0009 | 0.004 | 25 | 1325° C. × 70 hr | 176.6 |
| 5 | 0.005 | 0.05 | 0.3 | 0.001 | 0.0012 | 0.009 | 17 | 1370° C. × 45 hr | 188.8 |
| 6 | 0.006 | 0.04 | 0.3 | 0.002 | 0.0030 | 0.015 | 45 | 1350° C. × 50 hr | 175.5 |
| Comparative Example | | | | | | | | | |
| 7 | 0.005 | 0.03 | 0.3 | 0.002 | 0.0005 | 0.010 | 18 | none | 0 |
| 8 | 0.006 | 0.02 | 0.2 | 0.003 | 0.0010 | 0.008 | 15 | 1100° C. × 5 hr | 8.4 |

TABLE 3-continued

| Materials corresponding to PD (36Ni alloy) | | | | | | | | | |
|---|---|---|---|---|---|---|---|---|---|
| 9 | 0.007 | 0.03 | 0.3 | 0.002 | 0.0009 | 0.011 | 20 | 1200° C. × 20 hr | 38.7 |
| 10 | 0.006 | 0.05 | 0.2 | 0.001 | 0.0008 | 0.007 | 21 | 1300° C. × 3 hr | 30.9 |
| 11 | 0.005 | 0.02 | 0.3 | 0.002 | 0.0007 | 0.009 | 17 | 1350° C. × 50 hr | 175.5 |
| 12 | 0.006 | 0.04 | 0.3 | 0.002 | 0.0005 | 0.150 | 15 | 1325° C. × 70 hr | 176.6 |
| 13 | 0.006 | 0.05 | 0.3 | 0.001 | 0.0066 | 0.005 | 75 | 1350° C. × 60 hr | 192.2 |
| 14 | 0.020 | 0.04 | 0.3 | 0.002 | 0.0010 | 0.009 | 12 | 1325° C. × 70 hr | 176.6 |
| 15 | 0.005 | 2.5 | 0.2 | 0.001 | 0.0012 | 0.010 | 20 | 1350° C. × 50 hr | 175.5 |
| 16 | 0.006 | 0.05 | 3.5 | 0.002 | 0.0012 | 0.009 | 22 | 1250° C. × 10 hr | 39.8 |
| 17 | 0.007 | 0.03 | 0.3 | 0.050 | 0.0008 | 0.010 | 18 | 1250° C. × 45 hr | 84.5 |

| | Direct current magnetization properties | | | | | | | |
|---|---|---|---|---|---|---|---|---|
| No. | Maximum permeability/ μm | Initial permeability μi | Hc/ Oe | $B_{20}$/ gauss | Alternating current magnetization property Effective permeability μ · (1 kHz) | Number of inclusions/ $mm^2$ | Ni segregation amount(%) | Equiaxed crystal ratio of slab(%) |
| Example | | | | | | | | |
| 1 | 85000 | 21000 | 0.025 | 13800 | 3500 | 7.8 | 0.08 | 0 |
| 2 | 65000 | 15400 | 0.020 | 13600 | 3200 | 8.2 | 0.11 | 0 |
| 3 | 55000 | 10500 | 0.035 | 13600 | 3100 | 10.5 | 0.14 | 0 |
| 4 | 78000 | 19800 | 0.035 | 13600 | 3300 | 6.8 | 0.09 | 0.2 |
| 5 | 90000 | 25400 | 0.015 | 13800 | 4000 | 9.5 | 0.07 | 0 |
| 6 | 56000 | 12000 | 0.035 | 13500 | 3000 | 18.8 | 0.09 | 0.1 |
| Comparative Example | | | | | | | | |
| 7 | 19100 | 5600 | 0.125 | 13500 | 1900 | 9.5 | 0.45 | 0 |
| 8 | 23600 | 7800 | 0.095 | 13600 | 2200 | 12.9 | 0.32 | 0.1 |
| 9 | 35000 | 9800 | 0.075 | 13500 | 2500 | 8.8 | 0.18 | 0 |
| 10 | 42000 | 10200 | 0.070 | 13800 | 2800 | 8.6 | 0.19 | 0.4 |
| 11 | 27500 | 9500 | 0.080 | 13500 | 2400 | 10.5 | 0.28 | 25.4 |
| 12 | 24500 | 7500 | 0.100 | 13400 | 2200 | 9.8 | 0.37 | 0.2 |
| 13 | 22000 | 6900 | 0.105 | 13500 | 1800 | 60.7 | 0.06 | 0 |
| 14 | 35000 | 7050 | 0.095 | 13500 | 2000 | 10.5 | 0.08 | 0.2 |
| 15 | 24000 | 6900 | 0.100 | 13400 | 2200 | 8.9 | 0.10 | 0 |
| 16 | 34000 | 8200 | 0.090 | 13500 | 2400 | 12.6 | 0.13 | 0 |
| 17 | 28000 | 8500 | 0.095 | 13600 | 2400 | 15.8 | 0.12 | 0.1 |

TABLE 4

| Materials corresponding to PB (46Ni alloy) | | | | | | | | | |
|---|---|---|---|---|---|---|---|---|---|
| | Trace components | | | | | | | Homogenizing heat treatment | |
| No. | C | Si | Mn | P | S | Al | O/ppm | Temperature · Time | $(D \cdot t)^{0.5}$/μm |
| Example | | | | | | | | | |
| 18 | 0.005 | 0.05 | 0.2 | 0.001 | 0.0005 | 0.004 | 22 | 1350° C. × 50 hr | 175.5 |
| 19 | 0.006 | 0.02 | 0.2 | 0.002 | 0.0006 | 0.009 | 24 | 1250° C. × 45 hr | 84.5 |
| 20 | 0.005 | 0.04 | 0.3 | 0.002 | 0.0009 | 0.012 | 20 | 1250° C. × 10 hr | 39.8 |
| 21 | 0.004 | 0.06 | 0.3 | 0.002 | 0.0011 | 0.008 | 18 | 1325° C. × 70 hr | 176.6 |
| 22 | 0.005 | 0.05 | 0.3 | 0.001 | 0.0010 | 0.007 | 8 | 1370° C. × 45 hr | 188.8 |
| 23 | 0.007 | 0.03 | 0.3 | 0.002 | 0.0045 | 0.001 | 35 | 1350° C. × 50 hr | 175.5 |
| Comparative Example | | | | | | | | | |
| 24 | 0.005 | 0.03 | 0.3 | 0.002 | 0.0008 | 0.010 | 18 | none | 0 |
| 25 | 0.006 | 0.04 | 0.3 | 0.002 | 0.0012 | 0.008 | 15 | 1100° C. × 5 hr | 8.4 |
| 26 | 0.006 | 0.04 | 0.3 | 0.002 | 0.0004 | 0.011 | 20 | 1200° C. × 20 hr | 38.7 |
| 27 | 0.006 | 0.05 | 0.2 | 0.001 | 0.0008 | 0.008 | 21 | 1300° C. × 3 hr | 30.9 |
| 28 | 0.005 | 0.04 | 0.3 | 0.002 | 0.0010 | 0.012 | 16 | 1350° C. × 50 hr | 175.5 |
| 29 | 0.006 | 0.02 | 0.2 | 0.003 | 0.0010 | 0.095 | 25 | 1325° C. × 70 hr | 176.6 |
| 30 | 0.006 | 0.05 | 0.3 | 0.001 | 0.0077 | 0.007 | 95 | 1350° C. × 60 hr | 192.2 |
| 31 | 0.025 | 0.05 | 0.2 | 0.002 | 0.0012 | 0.009 | 18 | 1325° C. × 70 hr | 176.6 |
| 32 | 0.004 | 1.8 | 0.2 | 0.001 | 0.0009 | 0.010 | 20 | 1350° C. × 50 hr | 175.5 |
| 33 | 0.004 | 0.05 | 2.8 | 0.002 | 0.0010 | 0.009 | 15 | 1250° C. × 10 hr | 39.8 |
| 34 | 0.005 | 0.03 | 0.3 | 0.075 | 0.0008 | 0.010 | 14 | 1250° C. × 45 hr | 84.5 |

TABLE 4-continued

| Materials corresponding to PB (46Ni alloy) | | | | | | | | |
|---|---|---|---|---|---|---|---|---|
| | Direct current magnetization properties | | | | | | | |
| No. | Maximum permeability/ μm | Initial permeability μi | Hc/ Oe | $B_{20}$/ gauss | Alternating current magnetization property Effective permeability μ · (1 kHz) | Number of inclusions/ $mm^2$ | Ni segregation amount(%) | Equiaxed crystal ratio of slab(%) |
| Example | | | | | | | | |
| 18 | 175000 | 45000 | 0.009 | 15800 | 5200 | 8.6 | 0.1 | 0.1 |
| 19 | 125000 | 35400 | 0.010 | 15900 | 4800 | 7.9 | 0.14 | 0 |
| 20 | 115000 | 35000 | 0.015 | 15800 | 4700 | 10.6 | 0.15 | 0.2 |
| 21 | 184000 | 39800 | 0.012 | 16000 | 5300 | 7 | 0.09 | 0.5 |
| 22 | 184000 | 45400 | 0.009 | 15800 | 5800 | 9.5 | 0.06 | 0.4 |
| 23 | 138000 | 32000 | 0.015 | 15950 | 4500 | 17.5 | 0.07 | 0.3 |
| Comparative Example | | | | | | | | |
| 24 | 65600 | 9800 | 0.090 | 15900 | 2900 | 7.5 | 0.42 | 0.1 |
| 25 | 75500 | 8800 | 0.075 | 15800 | 3200 | 9.5 | 0.35 | 0 |
| 26 | 95000 | 20200 | 0.065 | 18050 | 3500 | 10 | 0.17 | 0.4 |
| 27 | 87000 | 11000 | 0.065 | 16000 | 3600 | 8.8 | 0.19 | 0.5 |
| 28 | 68000 | 9500 | 0.070 | 16050 | 3000 | 10.5 | 0.25 | 32.5 |
| 29 | 55000 | 7500 | 0.105 | 15850 | 2200 | 11.2 | 0.1 | 0 |
| 30 | 72000 | 9500 | 0.095 | 15950 | 2800 | 35.6 | 0.05 | 0.2 |
| 31 | 72000 | 10500 | 0.075 | 15800 | 3100 | 12.5 | 0.1 | 0.4 |
| 32 | 82000 | 9500 | 0.080 | 15900 | 2900 | 8.7 | 0.09 | 0.3 |
| 33 | 75000 | 8800 | 0.095 | 15750 | 3000 | 7.8 | 0.13 | 0.1 |
| 34 | 88000 | 7200 | 0.100 | 15850 | 2800 | 9.8 | 0.14 | 0 |

TABLE 5

| Materials corresponding to PC (JIS alloy) | | | | | | | | | |
|---|---|---|---|---|---|---|---|---|---|
| | Trace components | | | | | | | Homogenizing heat treatment | |
| No. | C | Si | Mn | P | S | Al | O/ppm | Temperature · Time | $(D \cdot t)^{0.5}$/μm |
| Example | | | | | | | | | |
| 35 | 0.004 | 0.06 | 0.3 | 0.002 | 0.0005 | 0.002 | 9 | 1350° C. × 50 hr | 175.5 |
| 36 | 0.006 | 0.02 | 0.2 | 0.001 | 0.0004 | 0.005 | 5 | 1250° C. × 45 hr | 84.5 |
| 37 | 0.005 | 0.04 | 0.3 | 0.002 | 0.0006 | 0.009 | 6 | 1250° C. × 10 hr | 39.8 |
| 38 | 0.005 | 0.05 | 0.2 | 0.001 | 0.0007 | 0.007 | 8 | 1325° C. × 70 hr | 176.6 |
| 39 | 0.005 | 0.03 | 0.3 | 0.002 | 0.0008 | 0.008 | 10 | 1370° C. × 45 hr | 188.8 |
| 40 | 0.007 | 0.03 | 0.3 | 0.002 | 0.0025 | 0.010 | 25 | 1350° C. × 50 hr | 175.5 |
| Comparative Example | | | | | | | | | |
| 41 | 0.005 | 0.05 | 0.3 | 0.001 | 0.0007 | 0.015 | 7 | none | 0 |
| 42 | 0.006 | 0.04 | 0.3 | 0.002 | 0.0009 | 0.007 | 10 | 1100° C. × 5 hr | 8.4 |
| 43 | 0.006 | 0.02 | 0.2 | 0.002 | 0.0005 | 0.011 | 8 | 1200° C. × 20 hr | 38.7 |
| 44 | 0.006 | 0.05 | 0.2 | 0.001 | 0.0008 | 0.008 | 10 | 1300° C. × 3 hr | 30.9 |
| 45 | 0.005 | 0.03 | 0.3 | 0.002 | 0.0006 | 0.008 | 8 | 1350° C. × 50 hr | 175.5 |
| 46 | 0.006 | 0.04 | 0.3 | 0.002 | 0.0005 | 0.052 | 7 | 1325° C. × 70 hr | 176.6 |
| 47 | 0.006 | 0.05 | 0.3 | 0.001 | 0.0060 | 0.005 | 67 | 1350° C. × 60 hr | 192.2 |
| 48 | 0.042 | 0.05 | 0.3 | 0.002 | 0.0009 | 0.009 | 10 | 1325° C. × 70 hr | 176.6 |
| 49 | 0.004 | 2.3 | 0.2 | 0.001 | 0.008 | 0.010 | 9 | 1350° C. × 50 hr | 175.5 |
| 50 | 0.005 | 0.04 | 3.2 | 0.002 | 0.0010 | 0.008 | 8 | 1250° C. × 10 hr | 39.8 |
| 51 | 0.003 | 0.03 | 0.3 | 0.055 | 0.0007 | 0.010 | 14 | 1250° C. × 45 hr | 84.5 |

| | Direct current magnetization properties | | | | | | | |
|---|---|---|---|---|---|---|---|---|
| No. | Maximum permeability/ μm | Initial permeability μi | Hc/ Oe | $B_{20}$/ gauss | Alternating current magnetization property Effective permeability μ · (1 kHz) | Number of inclusions/ $mm^2$ | Ni segregation amount(%) | Equiaxed crystal ratio of slab(%) |
| Example | | | | | | | | |
| 35 | 850000 | 365000 | 0.0045 | 7900 | 6500 | 2.5 | 0.09 | 0.1 |
| 36 | 560000 | 228000 | 0.0050 | 7950 | 7600 | 1.8 | 0.12 | 0.2 |
| 37 | 450000 | 219000 | 0.0055 | 7850 | 7500 | 3.6 | 0.15 | 0.4 |
| 38 | 580000 | 334000 | 0.0050 | 8000 | 6500 | 4.2 | 0.09 | 0.1 |
| 39 | 720000 | 495000 | 0.0030 | 7850 | 9700 | 5.4 | 0.06 | 0.2 |
| 40 | 460000 | 205000 | 0.0055 | 7900 | 6000 | 7.5 | 0.08 | 0.5 |

TABLE 5-continued

| Materials corresponding to PC (JIS alloy) | | | | | | | | |
|---|---|---|---|---|---|---|---|---|
| Comparative Example | | | | | | | | |
| 41 | 254000 | 76000 | 0.0080 | 7850 | 5400 | 4.5 | 0.39 | 0.4 |
| 42 | 278000 | 88000 | 0.0075 | 7900 | 5500 | 3.8 | 0.32 | 0.2 |
| 43 | 298000 | 92000 | 0.0070 | 8050 | 5800 | 2.8 | 0.16 | 0 |
| 44 | 285000 | 95000 | 0.0070 | 8000 | 5900 | 5.4 | 0.19 | 0.1 |
| 45 | 267000 | 88000 | 0.0075 | 7950 | 4900 | 5.8 | 0.35 | 45.5 |
| 46 | 198000 | 63500 | 0.0100 | 7950 | 4500 | 6.5 | 0.10 | 0.5 |
| 47 | 220000 | 85000 | 0.0090 | 8000 | 5200 | 32.5 | 0.06 | 0.1 |
| 48 | 248000 | 82000 | 0.0105 | 7900 | 4800 | 8.4 | 0.12 | 0.4 |
| 49 | 256000 | 95000 | 0.0095 | 8050 | 5000 | 6.5 | 0.08 | 0.3 |
| 50 | 187000 | 79000 | 0.105 | 7950 | 4200 | 3.5 | 0.11 | 0.5 |
| 51 | 215000 | 65000 | 0.115 | 7850 | 4000 | 5.4 | 0.12 | 0.2 |

As mentioned above, according to the invention, there can be provided Fe—Ni based permalloys having magnetic properties considerably higher than those of the conventional technique. Particularly, there can be obtained PD materials as a substitute of PB material used in a stator for watch, ball beads for electromagnetic lens and the like, PB materials as a substitute of PC material used as a magnetic head, a magnetic shielding material, a transformer core for communication equipments and the like, and PC materials having excellent magnetic properties and indicating high sensitivity and frequency characteristics, respectively.

What is claimed is:

1. A cast slab for a Fe—Ni based permalloy comprising Ni: 30–85 wt %, C: not more than 0.015 wt %, Si: not more than 1.0 wt %, Mn: not more than 1.0 wt %, P: not more than 0.01 wt %, S: not more than 0.005 wt %, O: not more than 0.0060 wt %, Al: not more than 0.02 wt % and the remainder being Fe and inevitable impurities, and having such a cast texture that an area ratio of equiaxed crystal is not more than 1%, for hot roll sheet provided Ni segregation amount $C_{Ni}s$ represented by the following equation is not more than 0.15 wt %:

$$C_{Ni}s = \text{analytical value of Ni component (wt \%)} \times Ci_{Ni}s\ (c.p.s.)/Ci_{Ni}ave.\ (c.p.s.)$$

wherein $Ci_{Ni}s$: a standard deviation of X-ray intensity (c.p.s.)

$Ci_{Ni}ave.$: an average intensity of total X-ray intensities (c.p.s.).

2. A cast slab for a Fe—Ni based permalloy according to claim 1, wherein the slab further contains not more than 15 wt % of at least one selected from the group consisting of Mo, Cu, Co and Nb within a range of not more than 20 wt % in total.

* * * * *

UNITED STATES PATENT AND TRADEMARK OFFICE

CERTIFICATE OF CORRECTION

PATENT NO. : 7,226,515 B2
APPLICATION NO. : 10/424818
DATED : June 5, 2007
INVENTOR(S) : Itoh et al.

It is certified that error appears in the above-identified patent and that said Letters Patent is hereby corrected as shown below:

On the title page item [73]: Assignee "Hippon Yakin Kogyo Co., Ltd" should read

--Nippon Yakin Kogyo Co., Ltd--.

Signed and Sealed this

Eighth Day of April, 2008

JON W. DUDAS
*Director of the United States Patent and Trademark Office*